US006789489B1

(12) United States Patent
Phipps

(10) Patent No.: US 6,789,489 B1
(45) Date of Patent: Sep. 14, 2004

(54) SAILBOAT WITH GIMBALED MAST AND KEEL

(76) Inventor: Jeffrey S. Phipps, 500 Orchard Pond Rd., Tallahassee, FL (US) 32312

( * ) Notice: Subject to any disclaimer, the term of this patent is extended or adjusted under 35 U.S.C. 154(b) by 0 days.

(21) Appl. No.: 10/458,902

(22) Filed: Jun. 11, 2003

(51) Int. Cl.[7] ..... B63B 41/00

(52) U.S. Cl. ..... 114/39.24; 114/39.15; 114/91; 114/143; 114/280

(58) Field of Search ..... 114/39.12, 39.13, 114/39.15, 39.24, 39.21, 280, 282, 91, 141, 143

(56) References Cited

U.S. PATENT DOCUMENTS

| | | | |
|---|---|---|---|
| 3,885,212 | A | 5/1975 | Marcil |
| 3,903,827 | A | 9/1975 | Marcil |
| 3,972,300 | A | 8/1976 | Adamski |
| 4,610,212 | A | 9/1986 | Petrovich |
| 4,854,904 | A | 8/1989 | Wahl |
| 4,934,296 | A | 6/1990 | Smith et al. |
| 5,072,682 | A | 12/1991 | Rodriguez Urroz et al. |
| 5,076,186 | A | 12/1991 | Girard |
| 5,152,238 | A | 10/1992 | Page |
| 5,280,760 | A | 1/1994 | Edwards |
| 5,309,859 | A | 5/1994 | Miller |
| 5,355,817 | A | 10/1994 | Schrems |
| 5,462,001 | A | 10/1995 | Lemelson |
| 5,471,942 | A | 12/1995 | Miller et al. |
| 5,908,005 | A | 6/1999 | Everett |
| 6,439,940 | B1 | 8/2002 | Pouchkarev |

FOREIGN PATENT DOCUMENTS

GB 2 187 152 A * 9/1987

* cited by examiner

*Primary Examiner*—Sherman Basinger
(74) *Attorney, Agent, or Firm*—John Wiley Horton

(57) ABSTRACT

A modified mast and keel system for a sailing vessel. The mast is gimbaled to the hull, so that it can move in a pitch roll. A downward extension of the mast pivotally connects to a winged keel. An aft strut also pivotally connects to the hull and pivotally connects to the winged keel. The hull, the mast extension, the winged keel, and the aft strut combine to form a traditional four bar linkage which is used to adjust the angle of attack of the winged keel with respect to the vessel. The winged keel moves with the mast in pitch and roll. It also includes a hydrofoil having an angle of attack which can be changeable in response to the pitching of the mast. This hydrofoil thereby generates downforce which counteracts the lifting forces created by the mast. It also creates lateral forces to counteract the sideslip of the vessel.

8 Claims, 14 Drawing Sheets

SAILBOAT WITH GIMBALED MAST AND KEEL

BACKGROUND OF THE INVENTION

1. Field of the Invention

This invention relates to the field of marine vessels. More specifically, the invention comprises a wind-powered vessel having a gimbaled mast and winged keel.

2. Description of the Related Art

Sail-powered surfboards, canoes, and similar watercraft have come into widespread use during recent years. Most of these devices employ a fairly rigid mast attached to a surfboard by a pivot joint. Some, however, employ a large "kite"-type sail in place of a fixed one. This kite type sail is attached to the end of a long tether and may be allowed to ascend many feet ahead of and above the vessel. FIG. 1 shows one example of such a sail, designated as sail 10. FIG. 1 does not show a prior art device. In a prior art device, main sheet 14 would typically be attached to a harness worn by a person riding atop hull 18. It would not be attached directly to the craft.

Those skilled in the art will know that sail 10 can be adjusted in elevation such that the angle between main sheet 14 and the vessel approaches and exceeds forty-five degrees. In such a case, main sheet 14 (which—being a rope—only transmits tensile force) can exert considerable lifting force on the vessel. The vessel is only maintained on the surface via the weight of itself and its rider.

Those skilled in the art will also know that sail 10 will be blown in the direction of wind travel. The rider may not wish to go in this direction. However, when attempting to steer the prior art "kite"-powered vessels off this course, the vessel tends to "skid" along the surface rather than maintaining the desired course. The experienced rider must "cut an edge" of the board into the water to provide a source of lateral resistance.

BRIEF SUMMARY OF THE PRESENT INVENTION

The present invention comprises a modified mast and keel system for a sailing vessel. The mast is gimbaled to the hull, so that it can move in pitch and roll. A downward extension of the mast pivotally connects to a winged keel. An aft strut also pivotally connects to the hull and pivotally connects to the winged keel. The hull, the mast extension, the winged keel, and the aft strut combine to form a traditional four bar linkage which can be used to adjust the angle of attack of the winged keel with respect to the vessel. The four bar linkage can be set so that the winged keel maintain a constant pitch with respect to the hull. It can also be set to vary the pitch of the winged keel as the mast pivots upward and downward. Thus, the amount of downward or upward force created by the winged keel can be varied.

As the mast rolls in one direction, the winged keel rolls in the same direction beneath the hull, in order to keep the downforce generated by the winged keel in axial alignment with the forces placed on the hull by the gimbaled mast. As the mast pitches in one direction, the winged keel pitches in the same direction, again to keep the downforce in axial alignment with the mast.

REFERENCE NUMERALS IN THE DRAWINGS

| | | | |
|---|---|---|---|
| 10 | sail | 12 | leader |
| 14 | main sheet | 16 | mast |
| 18 | hull | 20 | sailboard |
| 22 | skeg | 24 | winged keel |
| 26 | hydrofoil | 28 | fore strut |
| 30 | aft strut | 32 | roll gimbal |
| 34 | fore bearing | 36 | aft bearing |
| 38 | mast foot | 40 | pitch gimbal |
| 42 | hull slot | 44 | fore slot |
| 46 | aft slot | 48 | aft strut gimbal |
| 50 | fore pivot | 52 | aft pivot |
| 54 | elevator | | |

DESCRIPTION OF THE INVENTION

Figure 1:
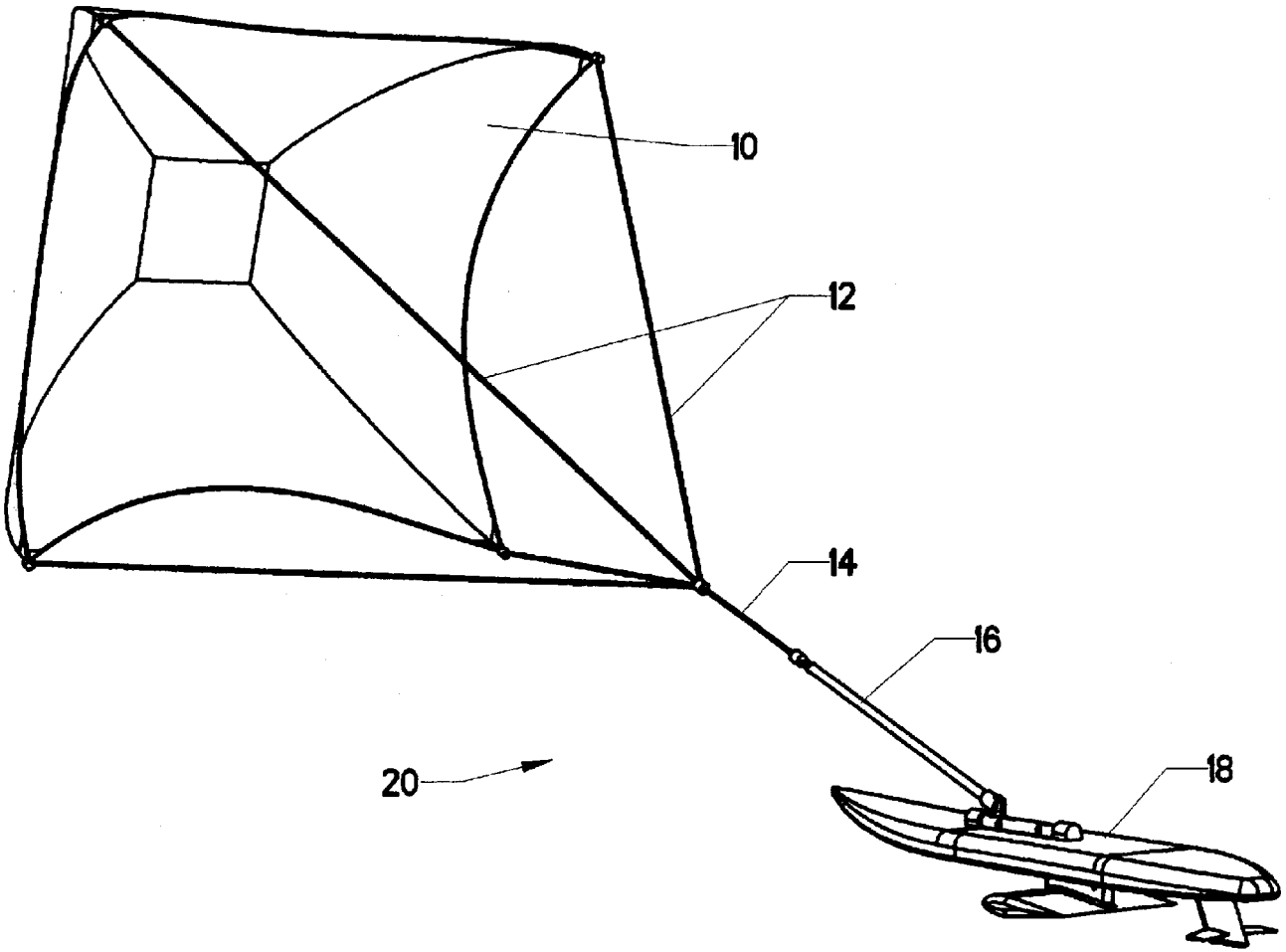
FIG. 1 is a perspective view, showing the present invention with a sail attached.

FIG. 1 shows a complete assembly denoted as sailboard 20. Motive force is supplied by sail 10, which is similar in operation to a kite. For the particular version shown, the large sail area is connected to four leaders 12 (Many other types are known in the art). The four leaders 12 are joined to a single main sheet 14. The leaders and main sheet are typically made of flexible rope. Those skilled in the art will know that "kite"-type sails have numerous control features allowing a user to adjust their elevation, surface area facing the wind, and other features. These control features are well known in the art. As they are not significant to the present invention, they will not be illustrated nor described in detail. Throughout this disclosure, the reader should bear in mind that although a small vessel is used for purposes of illustration, the devices disclosed can be used on a vessel many times this size.

Main sheet 14 is attached to mast 16. Mast 16 is attached to hull 18 via a pivot joint which allows it to roll and pitch with respect to hull 18. Mast 16 is substantially rigid. Main sheet 14 transmits a tensile load to the upper extreme of mast 16, which load is ultimately transmitted to hull 18.

Figure 2:
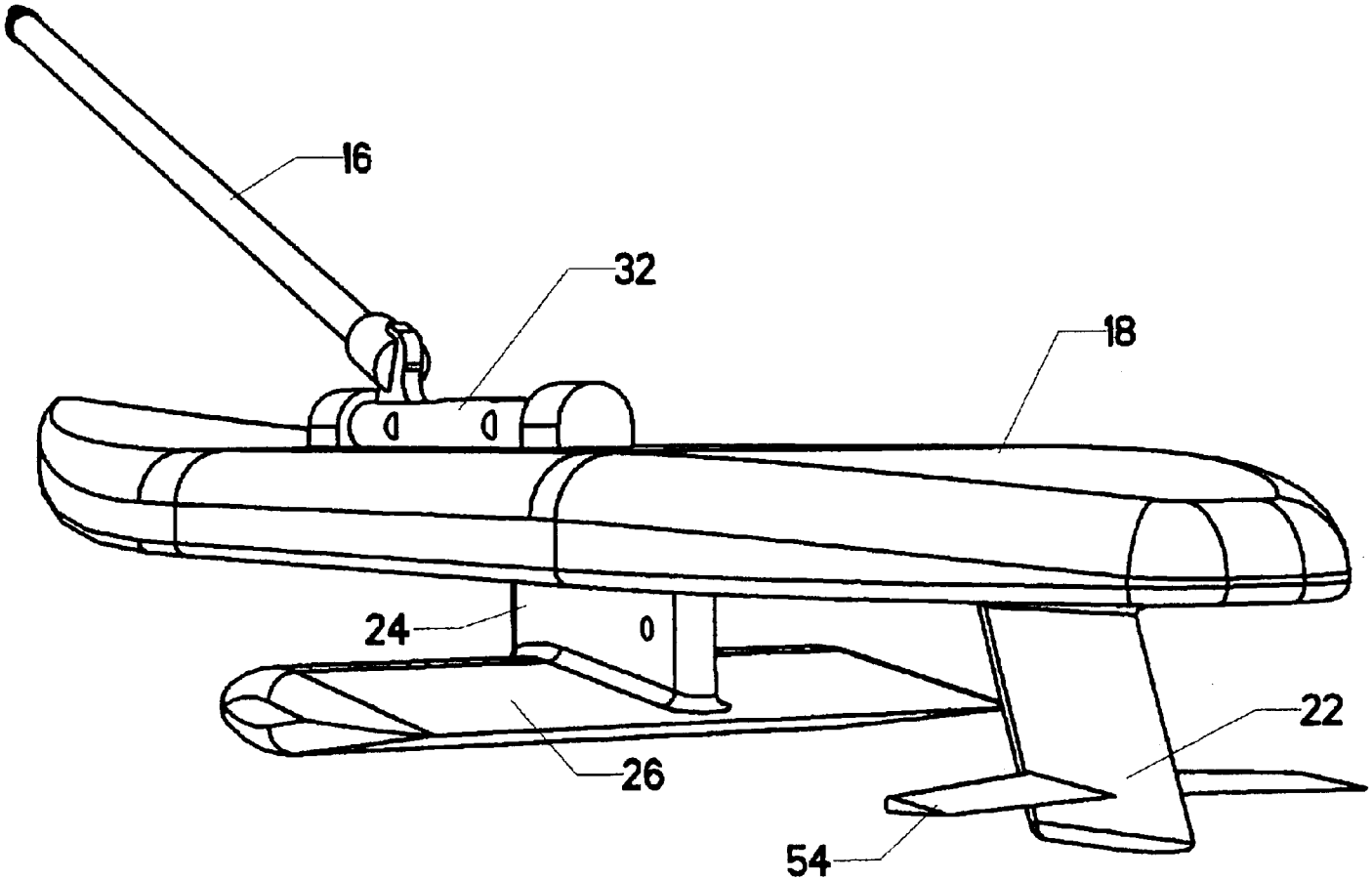
FIG. 2 is a perspective view, showing the present invention.

FIG. 2 is a closer view of hull 18. Skeg 22 descends from the rear portion of hull 18. It provides directional stability and can be made movable to assist in steering, like the rudder on a typical craft. Elevator 54 is preferably provided to add pitch stability. Mast 16 attaches to roll gimbal 32. Winged keel 24 also attaches to roll gimbal 32. The lower portion of winged keel 24 includes hydrofoil 26 (a "wing" shape), the purpose of which will be explained subsequently.

Figure 3:
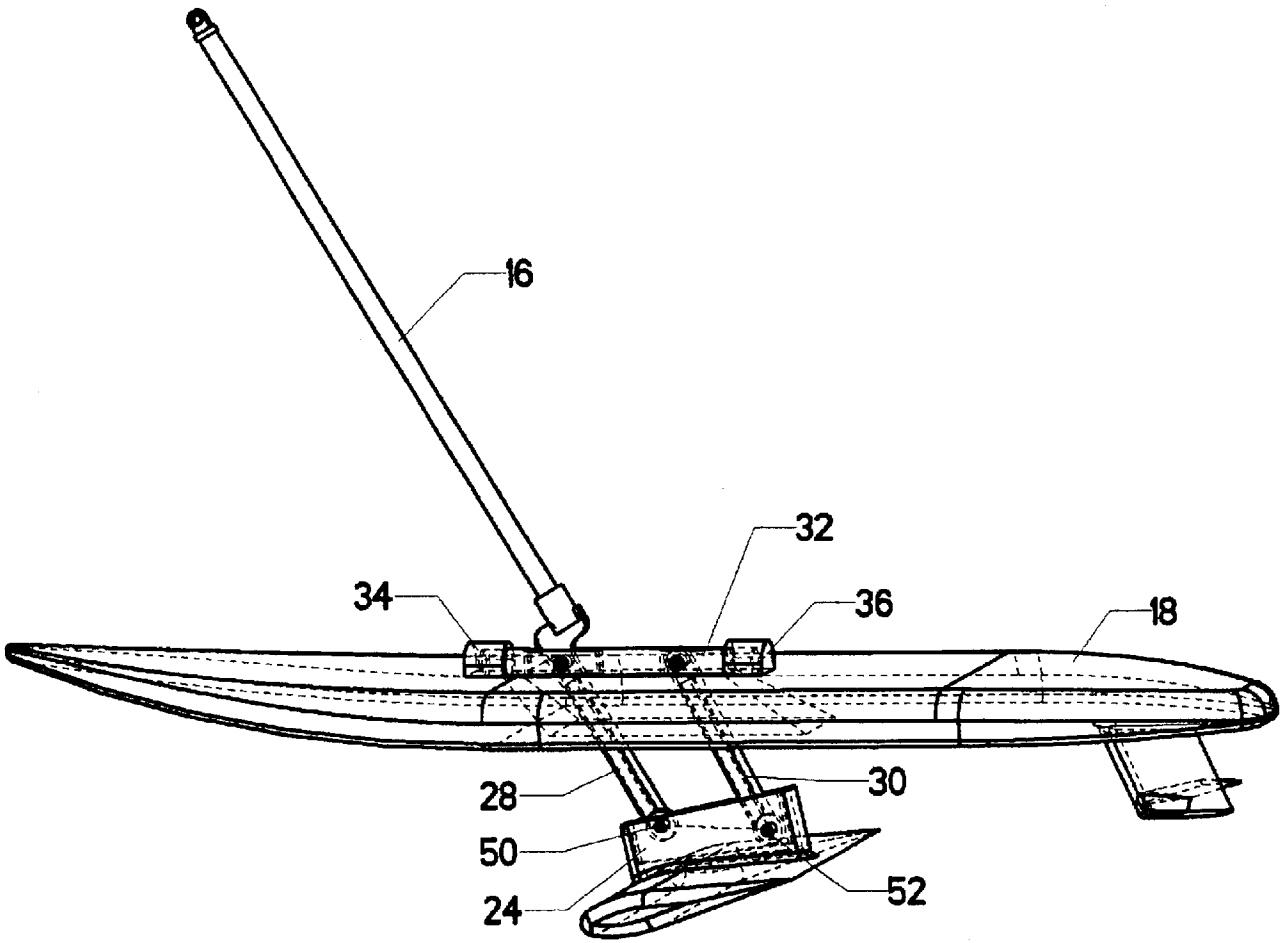
FIG. 3 is a hidden line view, showing the pitching characteristics of the winged keel.

FIG. 3 shows the vessel with mast 16 pitched upward somewhat. Winged keel 24 has pivoted downward from hull 18. This motion is caused by a pair of struts attaching winged keel 24 to roll gimbal 32. Fore strut 28 is rigidly attached to mast 16. It moves with the mast. The lower end of fore strut 28 is pivotally attached to winged keel 24 at fore pivot 50. Aft strut 30 is pivotally attached to the aft end of winged keel 24 at aft pivot 52. The upper end of aft strut 30 is pivotally attached to roll gimbal 32. Those skilled in the art will realize that roll gimbal 32, fore strut 28, winged keel 24, and aft strut 30 combine to form a classic four-bar linkage.

Figure 4:
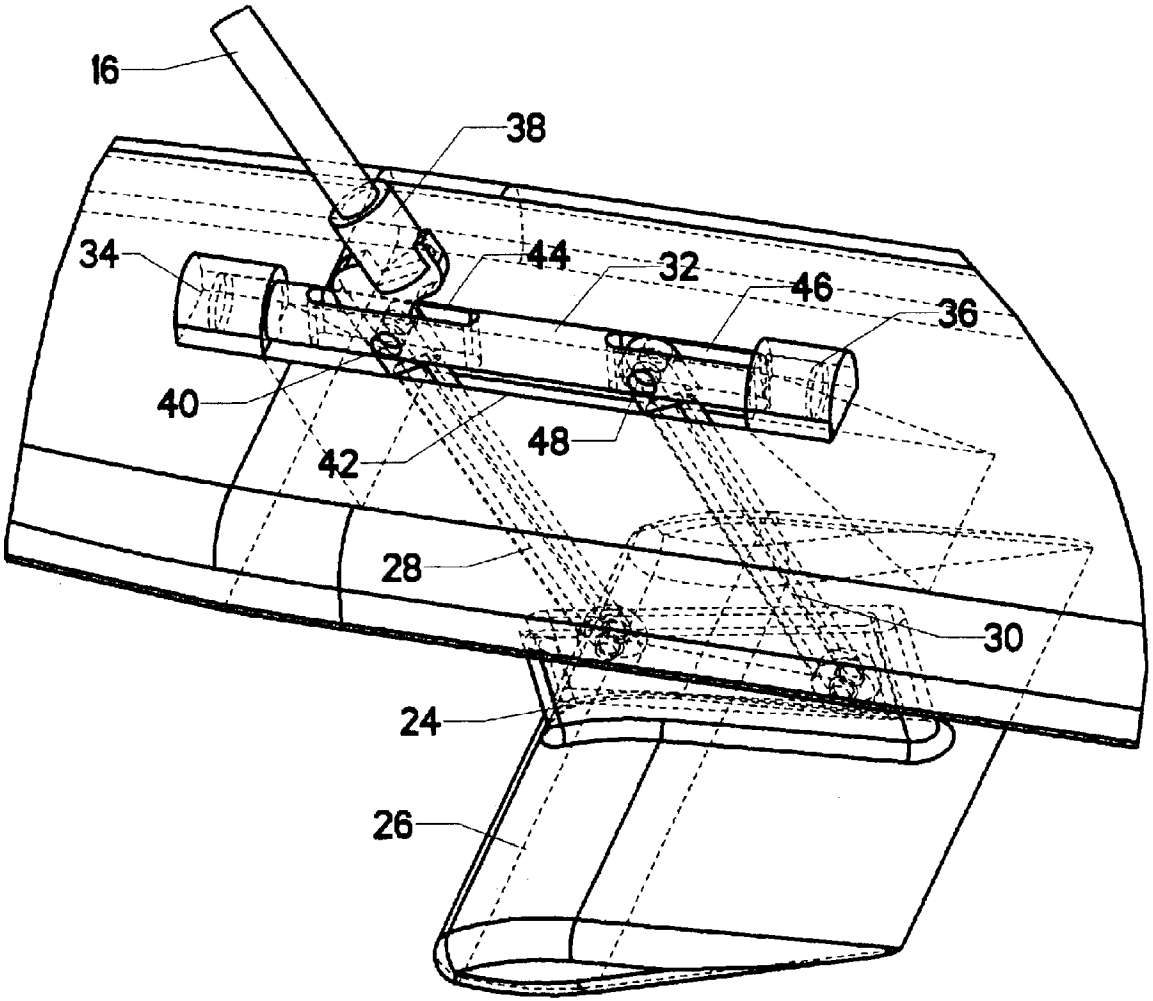
FIG. 4 is a hidden line view, showing details of the pitch and roll gimbals.

FIG. 4 shows these attachments in greater detail. Roll gimbal 32 is secured within fore bearing 34 and aft bearing 36. These two bearings link roll gimbal 32 to hull 18 while still allowing it to freely roll with respect to hull 18. Mast 16 is firmly attached within mast foot 38. Mast foot 38 is pivotally attached to roll gimbal 32 by pitch gimbal 40—which can be a bearing or simply a pin joint. Fore strut 28 descends from mast foot 38. Mast 16, mast foot 38, and fore strut 28 are all locked together so that they move as one unit. The "jogged" shape shown is provided to allow component clearance when mast 16 pitches upward and downward. Fore slot 44 is provided in roll gimbal 32 to provide clearance for the components.

Roll gimbal 32 also includes aft slot 46. This provides clearance for the upper end of aft strut 30, which is pivotally attached to roll gimbal 32 via aft strut gimbal 48. As explained previously, the lower ends of fore strut 28 and aft strut 30 are attached to winged keel 24.

The reader can readily observe in this view the shape of hydrofoil 26. Those skilled in the art will thus appreciate that the mechanisms described allow mast 16 to pitch upward and downward, and to roll side to side. Those skilled in the art will also realize that winged keel 24 will pitch and roll in response to the movements of mast 16.

Figure 5:
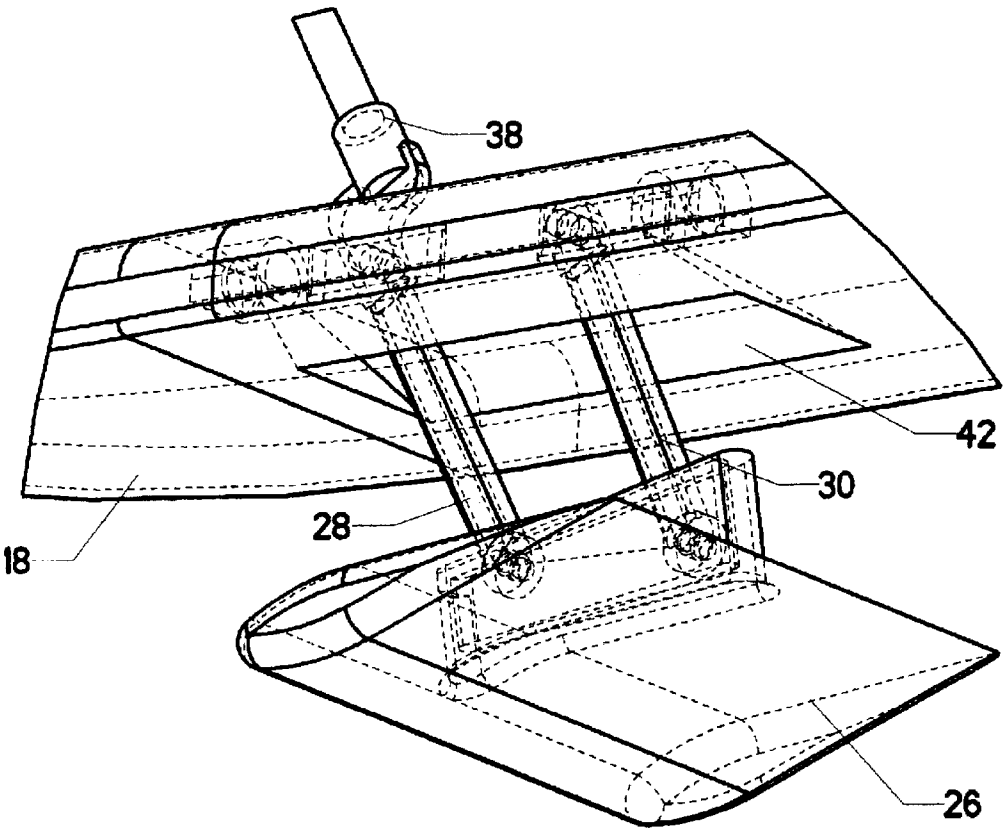
FIG. 5 is a hidden line view, showing how the winged keel is attached to the hull.

FIG. 5 shows the same area of the vessel from underneath. Hull slot 42 provides clearance for the two struts. It includes angled side walls to allow for the pitching and rolling motions of the two struts.

Figure 6:
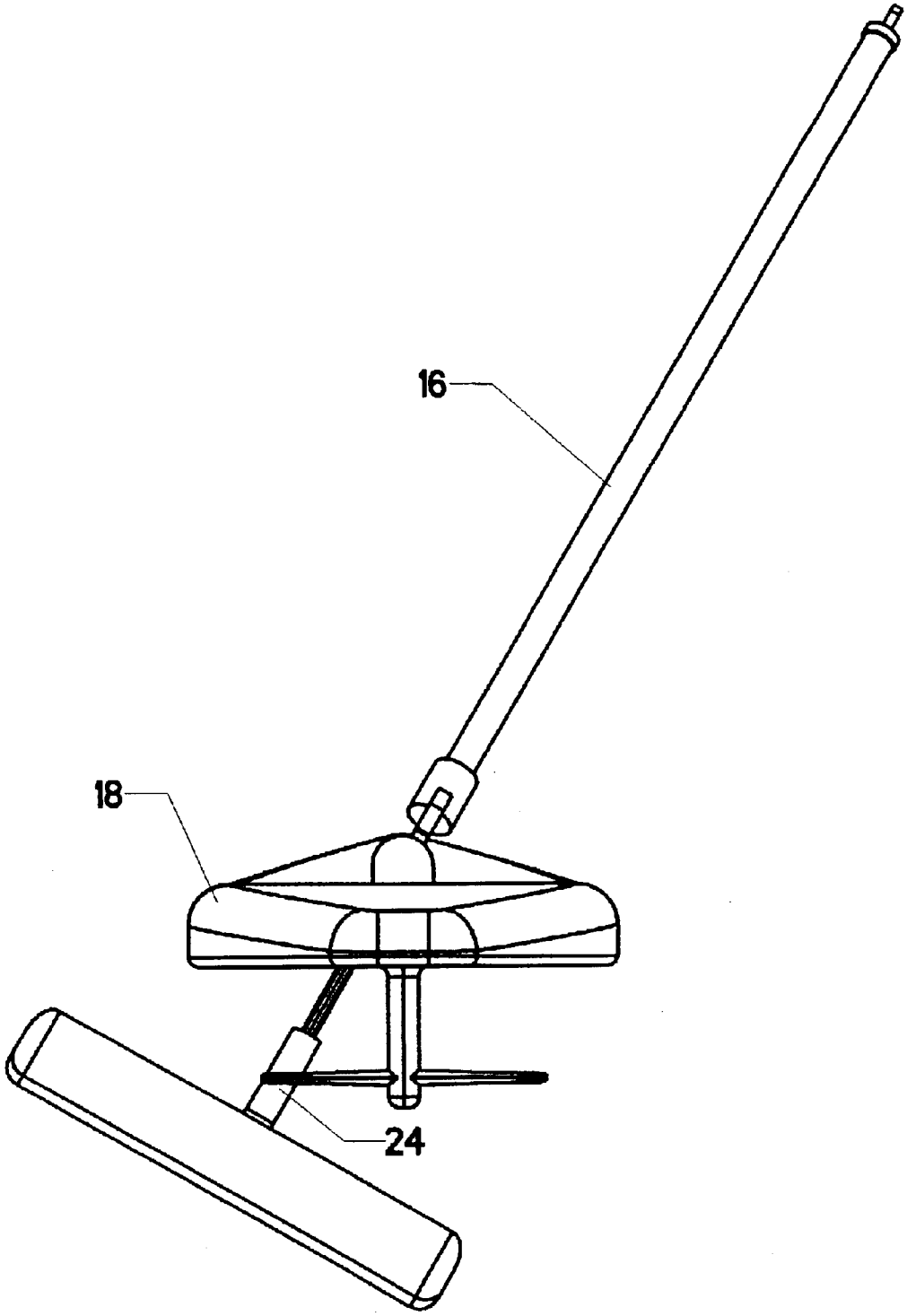
FIG. 6 is an elevation view, showing the operation of the roll gimbal.

The operation of the invention will now be described in detail. FIG. 6 shows a view of the vessel from astern. Since mast 16 is free to move in pitch and roll, it can only transmit tensile forces to the hull (A small amount of yaw can be transmitted, but for "kite"-type sails, this is not significant). In the configuration shown, the sail is above and to the right of the vessel. It therefore tends to lift the hull and drag the hull to the right. The person controlling the vessel in this configuration is attempting to steer a course to the left of the wind's travel. The desire is to use winged keel 24 to counteract the lifting forces and the forces tending to drag the vessel off course. The reader will observe in the view that mast 16 has rolled 30 degrees in a clockwise direction (With respect to its "neutral" vertical position). The operation of roll gimbal 32 and the other devices descended has caused winged keel 24 to roll through 30 degrees as well. Winged keel 24 thereby tends to counteract the uplifting force and the force tending to drag the vessel to the right. The result is that the vessel is able to hold a steady course, with all the forces acting in axial alignment.

Figure 7:
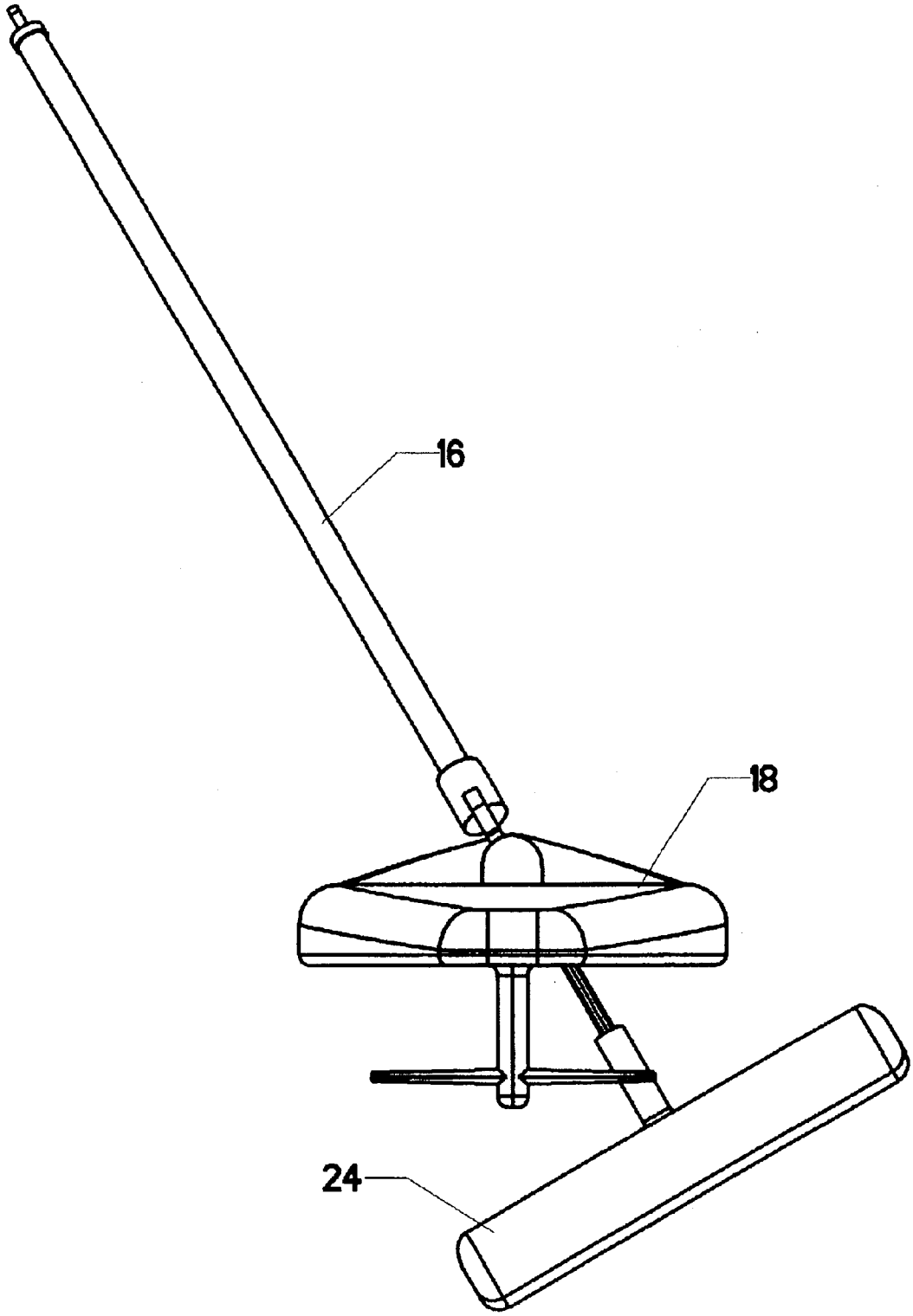
FIG. 7 is an elevation view, showing the operation of the roll gimbal.

FIG. 7 shows a situation where the desired course is to the right of the wind's travel. The sail is now above the vessel and to the left. Mast 16 has rolled 30 degrees in a counterclockwise direction. Winged keel 24 has also rolled 30 degrees in a counterclockwise direction. The forces generated by winged keel 24 therefore tend to be aligned with the central axis of mast 16.

Figure 8:
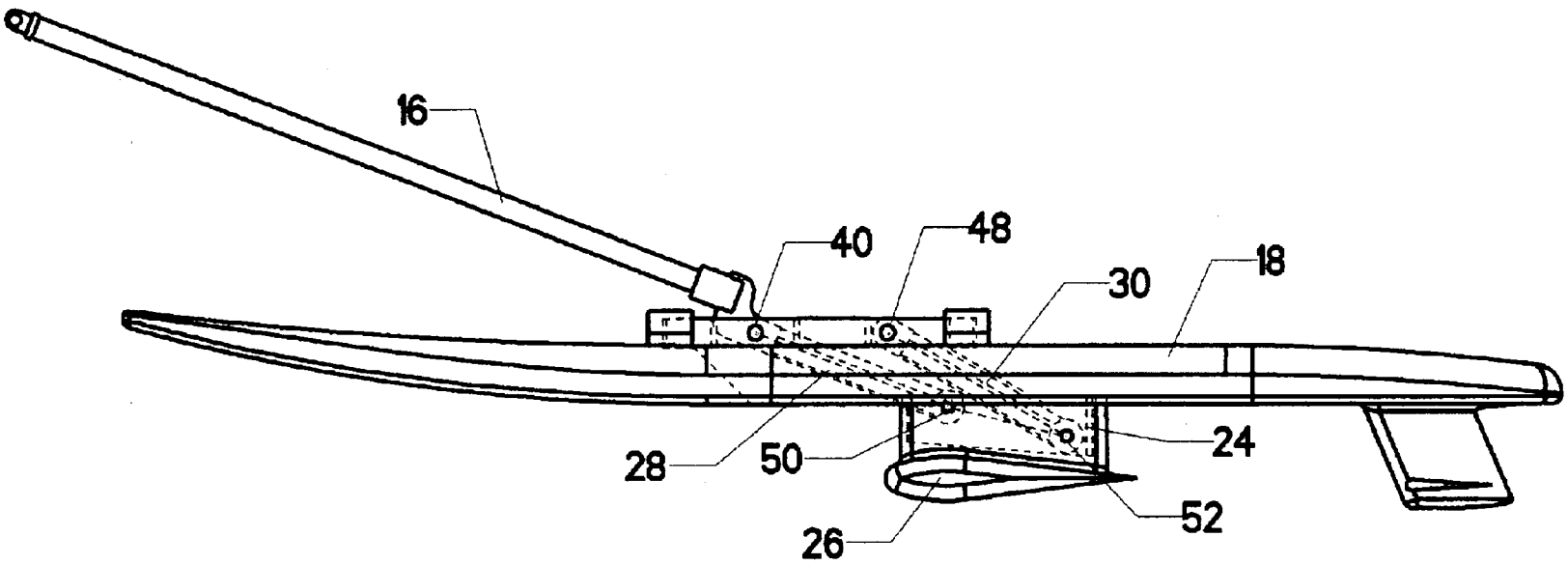
FIG. 8 is a hidden line view, showing the operation of the pitch gimbal.

The mechanisms disclosed perform a similar function with respect to pitch motions of mast 16—but with one additional degree of freedom. FIG. 8 shows mast 16 pitched far downward. Fore strut 28 and aft strut 30 are rotated to a position which retracts winged keel 24 up against the bottom of hull 18. The geometry of the four-bar linkage is defined so that the angle of attack of hydrofoil 26 is neutral at this point. In other words, hydrofoil 26 is not producing any downforce as the vessel moves through the water. The geometry in question is the position of the four pivot joints (pitch gimbal 40, aft strut gimbal 48, fore pivot 50, and aft pivot 52) in order to define the length of each "link" in the four-bar.

Figure 9:
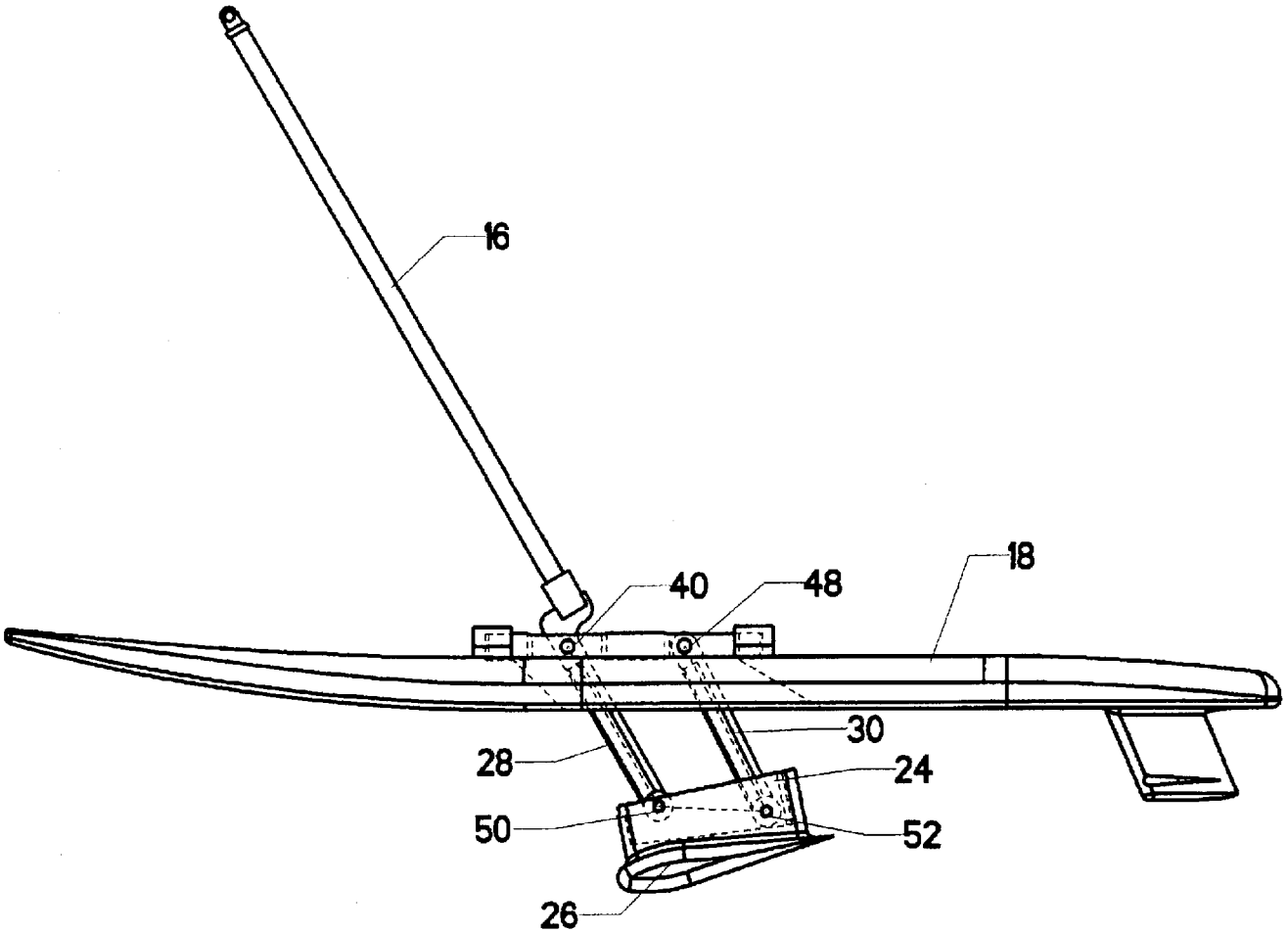
FIG. 9 is a hidden line view, showing the operation of the pitch gimbal.

In FIG. 9, mast 16 has pitched upward considerably. Fore strut 28 has pitched correspondingly downward, pulling winged keel 24 down and away from hull 18. The reader will also observe that the operation of the four-bar linkage has caused hydrofoil 26 to pitch downward. It now has a negative angle of attack, meaning that hydrofoil 26 will produce substantial downforce as the vessel moves through the water. This downforce is needed to counteract the uplifting force generated by the sail's tension on mast 16. Thus, by studying FIGS. 8 and 9, the reader will appreciate that as mast 16 pitches further upward, hydrofoil 26 is given a progressively more negative angle of attack. This, in turn, creates progressively more downforce. The result is that the uplifting forces tending to lift the vessel out of the water when the "kite"-type sail is in a relatively high position are counteracted.

Figure 10:
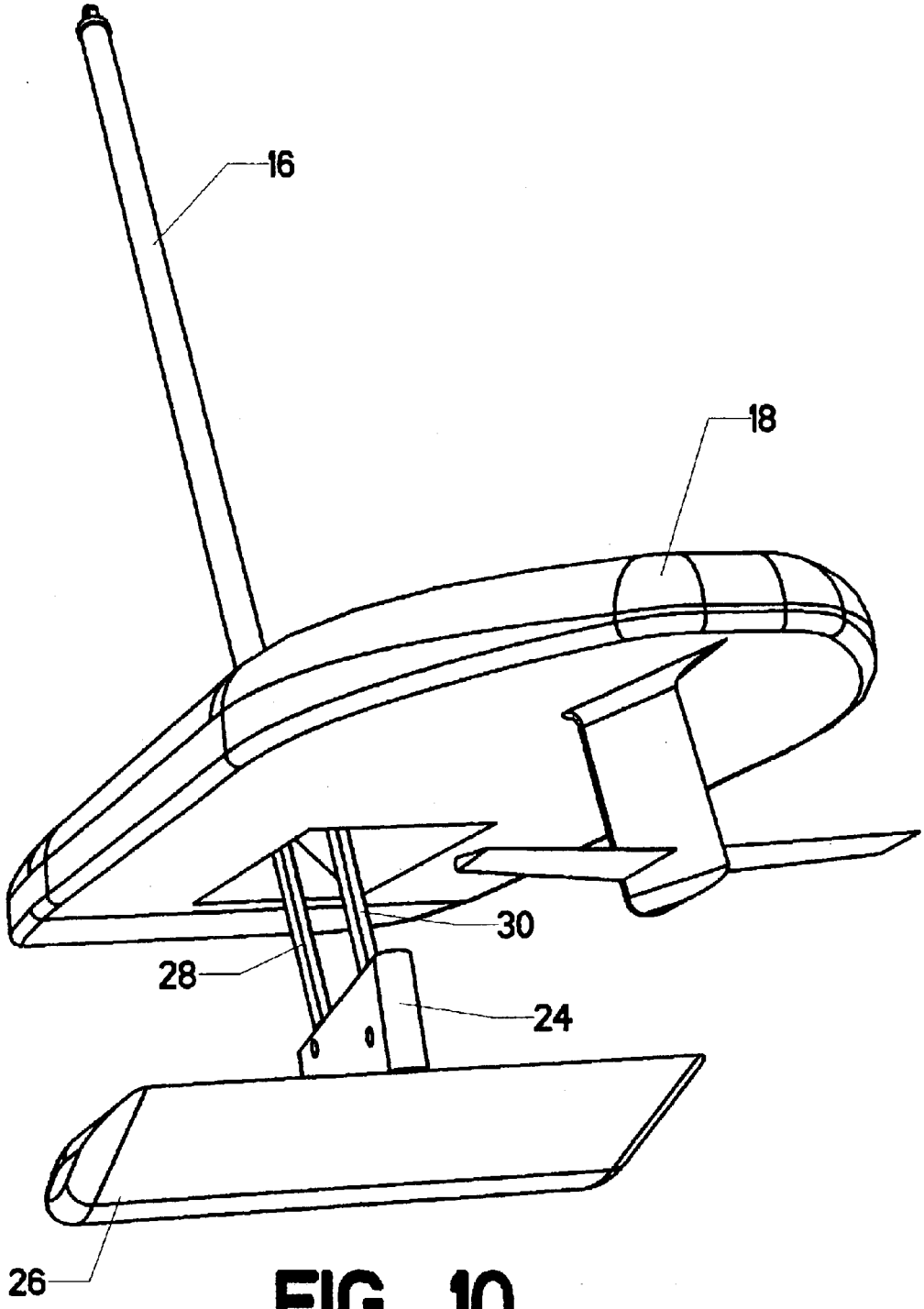
FIG. 10 is a perspective view, showing the invention from underneath.
Figure 11:
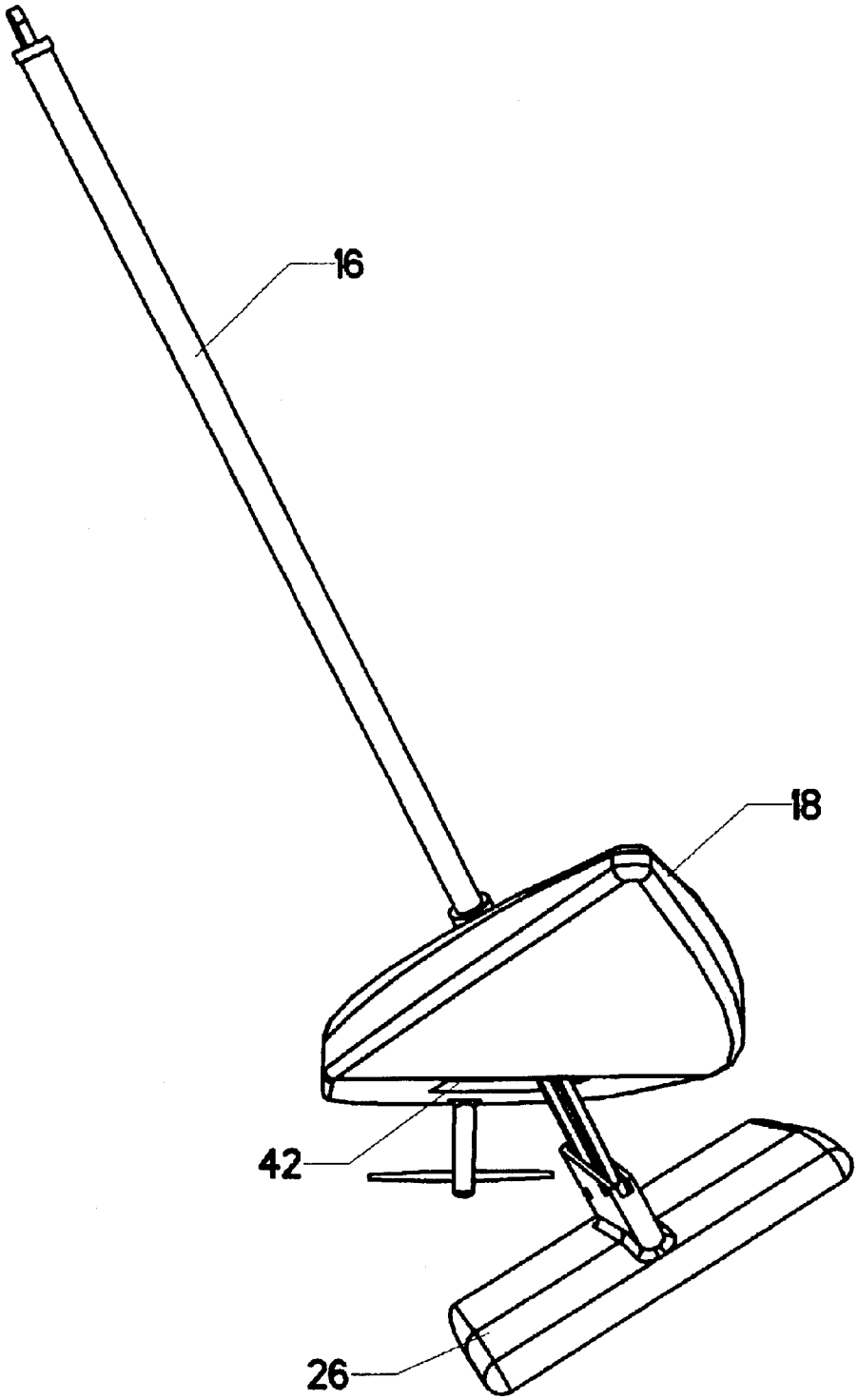
FIG. 11 is a perspective view, showing the invention from underneath.

FIG. 10 shows a perspective view of the vessel from underneath. The reader will observe how the orientation of winged keel 24 moves with mast 16. Of course, these motions in the pitch and roll axes occur simultaneously. That is, winged keel 24 is moved to accommodate mast motions in both pitch and roll. FIG. 11 is another view of the vessel from underneath the water surface—this time with the vessel approaching the viewer. Mast 16 is pitched upward and rolled in a clockwise direction (from the perspective of a person on the boat—counterclockwise from the perspective of the viewer). The reader will observe that the winged keel has rolled correspondingly, and that hydrofoil 16 has been inclined downward to create more downforce.

Figure 12:
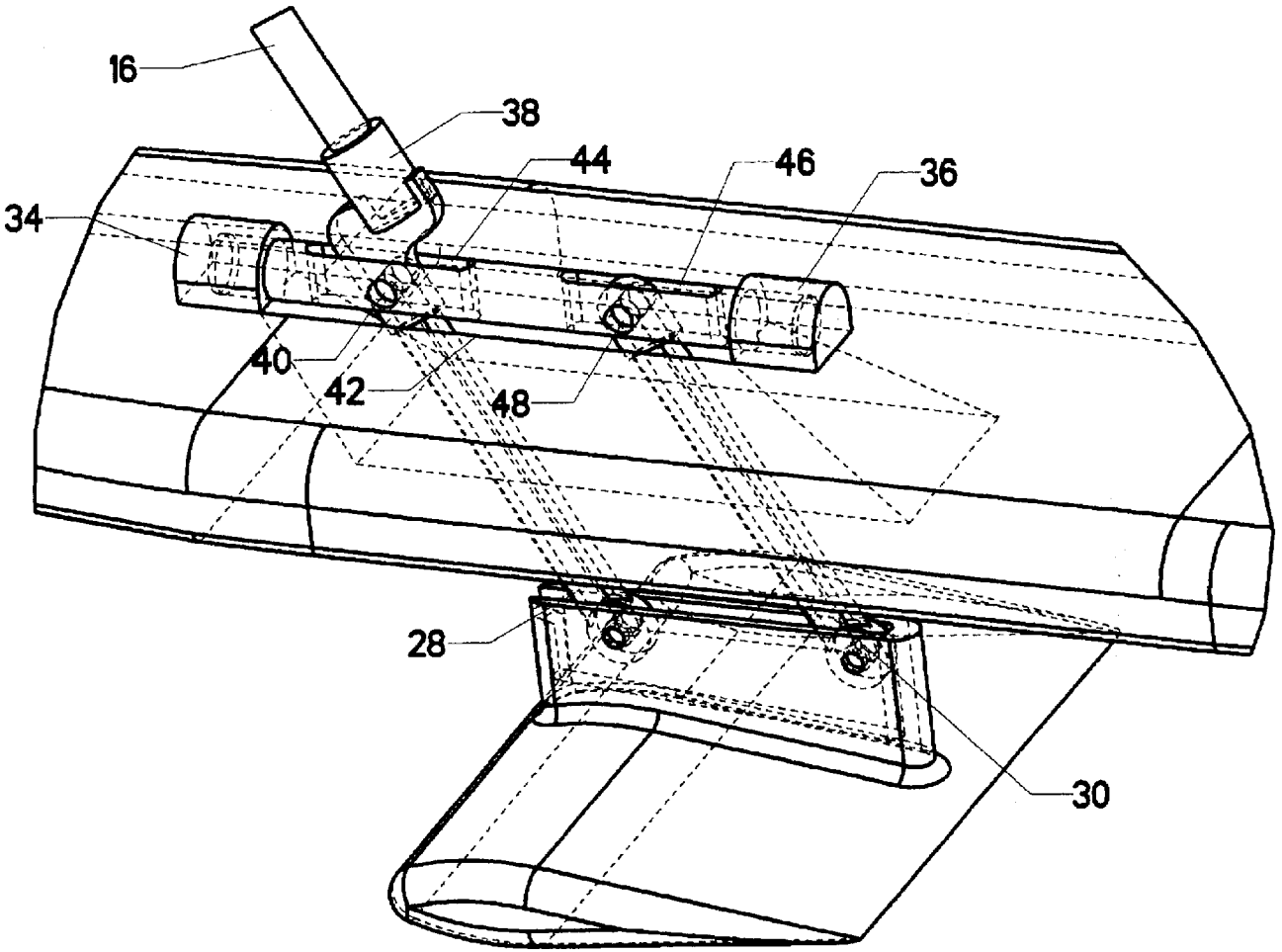
FIG. 12 is a hidden line view, showing a version which maintains a fixed angle of attack on the winged keel.

Those skilled in the art will know that the four bar mechanism disclosed can be altered to create an infinite variety of pitch functions for the winged keel with respect to the hull. The alteration in pitch can be made much smaller than depicted in the views. The pitch function can even be reversed so that as the mast pitches upward the winged keel pitches upward. Another desired configuration would be to maintain a constant pitch on the winged keel with respect to the hull. FIG. 12 shows such a configuration. A "parallel" four bar is created by matching the distance between pitch gimbal 40 and aft strut gimbal 48 to the distance between fore pivot 50 and aft pivot 52. Likewise, the length between the pivot joints on fore strut 28 and aft strut 30 are matched.

Figure 13:
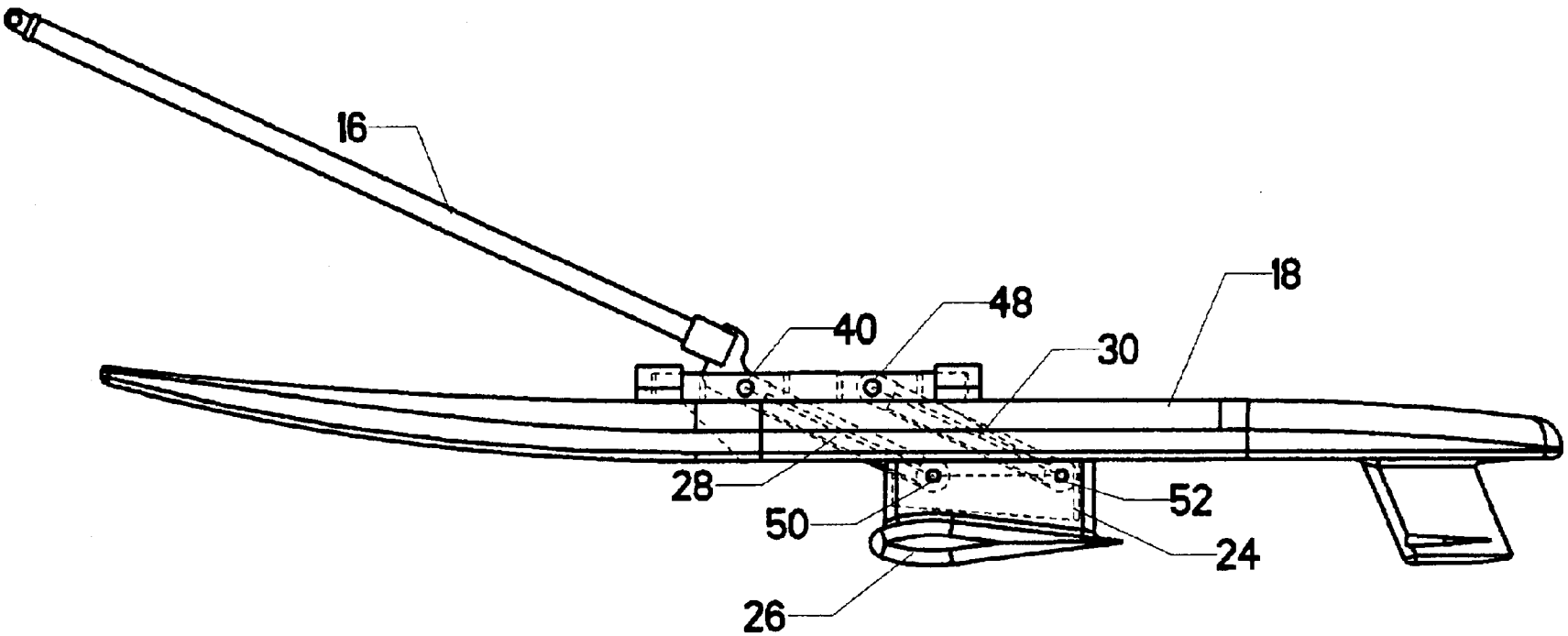
FIG. 13 is a hidden line view, showing the operation of the pitch gimbal.
Figure 14:
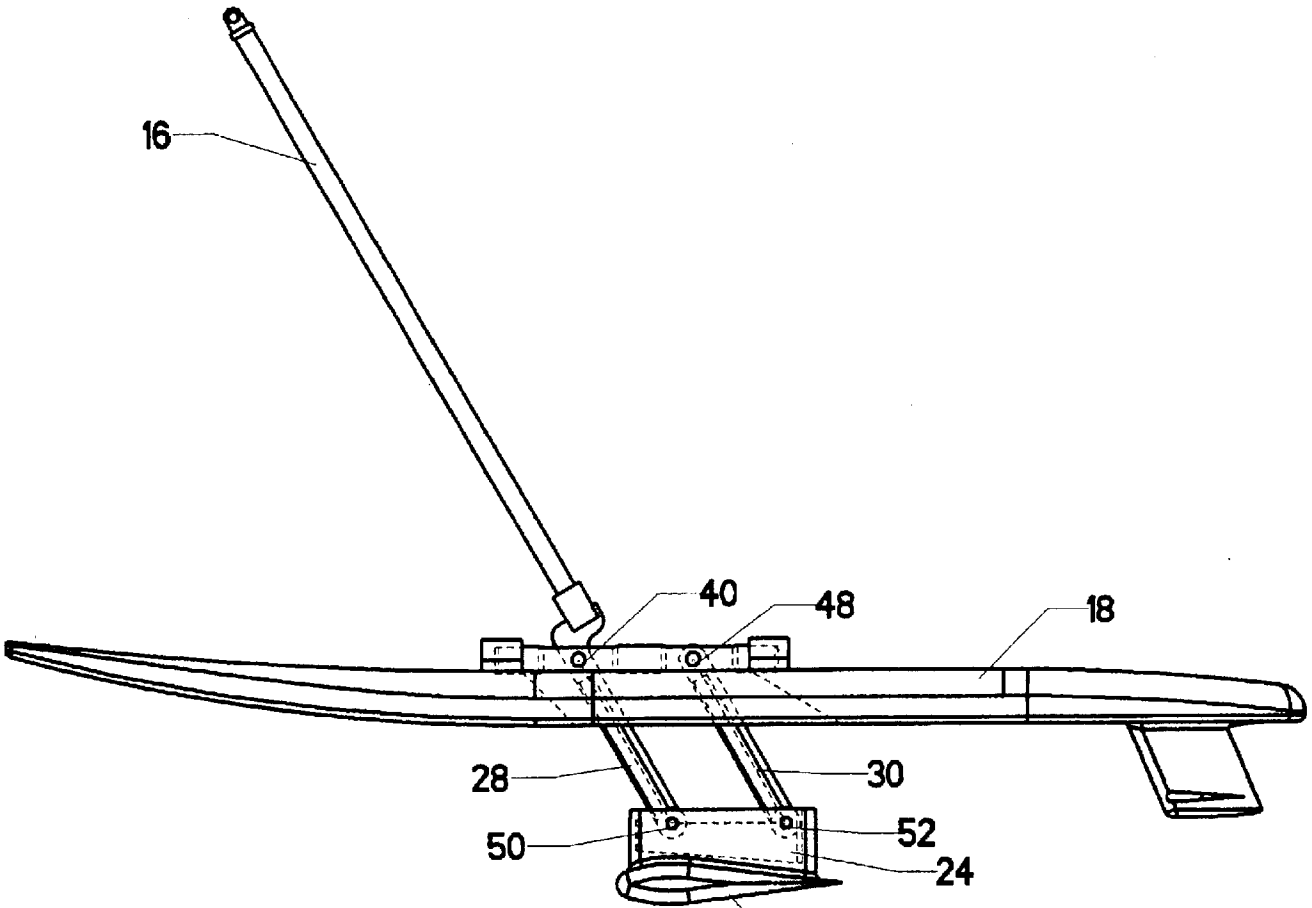
FIG. 14 is a hidden line view, showing the operation of the pitch gimbal.

FIG. 13 shows this configuration when mast 16 is pitched downward. FIG. 14 shows the same configuration when mast 16 is pitched upward. The reader will observe that the angle of attack for hydrofoil 26 on winged keel 24 remains constant with respect to hull 18. A constant pitch is maintained on the winged keel. Known mechanisms can be used to finely adjust the pitch of hydrofoil 26 with respect to winged keel 24. A small negative angle of attack can be set to increase downforce. The parallel four bar then maintains this pitch irrespective of the position of mast 16. The term "downforce" is understood to mean the a force generated by the hydrofoil. If the mast is rolled to one side, this force will obviously not act purely downward.

Although the preceding descriptions contain significant detail they should not be viewed as limiting the invention but rather as providing examples of the preferred embodiments of the invention. Many variations are possible. As one example, other types of "kite" sails can be substituted for the one shown. One other such type is disclosed in U.S. Pat. No. 4,610,212 to Petrovich (1986). The triangular sail shown in Petrovich could be attached to the end of mast 16 in the present invention, as could many other types. Accordingly, the scope of the invention should be determined by the following claims, rather than the examples given.

Having described my invention, I claim:

1. A sailboat, comprising:

a. a hull;

b. a mast, pivotally connected to said hull so that said mast can pitch with respect to said hull;

c. a sail, attached to said mast so as to transmit a wind load to said mast;

d. a fore strut, having an upper end and a lower end, wherein said upper end is rigidly attached to said mast;

e. a winged keel, having a fore portion, an aft portion, and a hydrofoil, wherein said fore portion is pivotally attached to said lower end of said fore strut;

f. an aft strut, having an upper end and a lower end, wherein said upper end is pivotally attached to said hull and wherein said lower end is pivotally attached to said aft portion of said winged keel, so that said hull, said fore strut, said winged keel, and said aft strut form a four bar linkage having four pivot joints separated by four fixed distances; and g. wherein said four fixed distances are selected so that as said mast pitches upward, said winged keel pitches downward.

2. A sailboat, comprising:

a. a hull;

b. a mast, pivotally connected to said hull so that said mast can pitch and roll with respect to said hull;

c. a sail attached to said mast so as to transmit a tensile load to said mast;

d. a fore strut, having an upper end and a lower end, wherein said upper end is rigidly attached to said mast;

e. a winged keel having a fore portion, an aft portion, and a hydrofoil, wherein said fore portion is pivotally attached to said lower end of said fore strut;

f. an aft strut, having an upper end and a lower end, wherein said upper end is pivotally attached to said hull so that said aft strut can pitch and roll with respect to said hull, and wherein said lower end is pivotally attached to said aft portion of said winged keel, so that said hull, said fore strut, said winged keel and said aft strut form a four bar linkage having four pivot joints separated by four fixed distances;

g. wherein said four fixed distances are selected so that as said mast pitches upward, said winged keel pitches downward; and h. wherein said fore strut, said winged keel and said aft strut roll in unison with said mast with respect to said hull.

3. A sailboat as recited in claim 1, wherein said sail is a kite-type sail.

4. A sailboat as recited in claim 2, wherein said sail is a kite-type sail.

5. A sailboat, comprising:

a. a hull;

b. a roll gimbal, pivotally connected to said hull so that said roll gimbal can roll with respect to said hull;

c. a mast, pivotally connected to said roll gimbal so that said mast can pitch with respect to said roll gimbal;

d. a sail, attached to said mast so as to transmit a tensile load to said mast;

e. a fore strut, having an upper end and a lower end, wherein said upper end is rigidly attached to said mast;

f. a winged keel, having a fore portion, an aft portion, and a hydrofoil, wherein said fore portion is pivotally attached to said lower end of said fore strut;

g. an aft strut, having an upper end and a lower end, wherein said upper end is pivotally attached to said roll gimbal, and wherein said lower end is pivotally attached to said aft portion of said winged keel, so that said roll gimbal, said fore strut, said winged keel, and said aft strut form a four bar linkage having four pivot joints separated by four fixed distances;

f. wherein said four fixed distances are selected so that as said mast pitches upward, said winged keel pitches downward; and g. wherein said fore strut, said winged keel, and said aft strut roll in unison with said mast with respect to said hull.

6. A sailboat as recited in claim 5, wherein said sail is a kite-type sail.

7. A sailboat, comprising:

a. a hull;

b. a roll gimbal, pivotally connected to said hull so that said roll gimbal can roll with respect to said hull;

c. a mast, pivotally connected to said roll gimbal so that said mast can pitch with respect to said roll gimbal;

d. a sail, attached to said mast so as to transmit a tensile load to said mast;

e. a fore strut, having an upper end and a lower end, wherein said upper end is rigidly attached to said mast;

f. a winged keel, having a fore portion, an aft portion, and a hydrofoil, wherein said fore portion is pivotally attached to said lower end of said fore strut;

g. an aft strut, having an upper end and a lower end, wherein said upper end is pivotally attached to said roll gimbal, and wherein said lower end is pivotally attached to said aft portion of said winged keel, so that said roll gimbal, said fore strut, said winged keel, and said aft strut form a four bar linkage having four pivot joints separated by four fixed distances;

h. wherein said four fixed distances are selected so that as said mast pitches upward and downward, said winged keel maintains a constant pitch with respect to said hull; and i. wherein said fore strut, said winged keel, and said aft strut roll in unison with said mast with respect to said hull.

8. A sailboat as recited in claim 7, wherein said sail is a kite-type sail.

* * * * *